US008770614B2

(12) United States Patent
Heil et al.

(10) Patent No.: US 8,770,614 B2
(45) Date of Patent: Jul. 8, 2014

(54) SNOW GLIDE BOARD, IN PARTICULAR SKI

(75) Inventors: Tobias Heil, Mitterfels (DE); Andreas Ametsbichler, Straubing (DE)

(73) Assignee: Marker Volkl (International) GmbH, Baar (CH)

( * ) Notice: Subject to any disclaimer, the term of this patent is extended or adjusted under 35 U.S.C. 154(b) by 0 days.

(21) Appl. No.: 12/314,243

(22) Filed: Dec. 5, 2008

(65) Prior Publication Data

US 2009/0146395 A1 Jun. 11, 2009

(30) Foreign Application Priority Data

Dec. 7, 2007 (DE) ..... 10 2007 059 228

(51) Int. Cl.
*A63C 5/00* (2006.01)
*A63C 5/04* (2006.01)

(52) U.S. Cl.
USPC ..... 280/609; 280/601; 280/607; 280/11.14

(58) Field of Classification Search
USPC ..... 280/600, 601, 607, 609, 610, 11.14, 280/11.18, 12.1, 14.22
See application file for complete search history.

(56) References Cited

U.S. PATENT DOCUMENTS

| | | | | |
|---|---|---|---|---|
| 6,641,162 | B2 * | 11/2003 | Allmann et al. | 280/607 |
| 2003/0193169 | A1 | 10/2003 | Holzinger et al. | |
| 2006/0131838 | A1 * | 6/2006 | Leitner | 280/607 |
| 2006/0163844 | A1 * | 7/2006 | Baumgartner et al. | 280/607 |
| 2007/0205582 | A1 * | 9/2007 | Himmetsberger et al. | 280/609 |

FOREIGN PATENT DOCUMENTS

| | | |
|---|---|---|
| DE | 20321008 | 8/2005 |
| EP | 1611927 | 1/2006 |
| EP | 1815894 | 8/2007 |

OTHER PUBLICATIONS

"Collection 07/08" Feb. 4, 2007, Blizzard Skis, Munich, XP002515113 Catalogue of the skis collection, distributed at ISPO trade fair on Feb. 4-7, 2007.

* cited by examiner

*Primary Examiner* — J. Allen Shriver, II
*Assistant Examiner* — Bryan Evans
(74) *Attorney, Agent, or Firm* — Welsh Flaxman & Gitler LLC

(57) ABSTRACT

The invention relates to a snow glide board, in particular a ski, having a glide board body and guide and mounting elements located in a binding area of the glide board body for interlocking mounting of a binding.

10 Claims, 2 Drawing Sheets

SNOW GLIDE BOARD, IN PARTICULAR SKI

BACKGROUND OF THE INVENTION

The invention relates to snow glide boards, in particular skis and especially to alpine skis.

Modern ski constructions are making increasing use of rail or strip-like guide and mounting elements for binding or mounting the respective binding or its functional element to the ski body, such elements generally being provided in pairs and across from each other crosswise to the ski body, and each element being provided with at least one guide or anchoring groove for the interlocking fit of the binding or binding element. In the existing art, it is particularly common practice to provide paired guide and mounting elements across from each other on facing sides of bead-shaped protrusions on the top of the ski body, preferably in recesses of said protrusions, on the one hand in order to achieve a visually attractive appearance and on the other hand to arrange the guide and mounting elements so that they are protected or at least protected as completely as possible on the top side of the ski body.

Especially, but not only, ski constructions of this type are often problematic with respect to the optimum transfer of forces between the guide and mounting elements and therefore between the binding and the outer edges of the ski, and especially if the respective ski or ski body is very wide.

It is an object of the invention is to present a snow glide board with a design that ensures optimum transfer of force from the binding or from the guide or mounting elements to the outer edges of the ski.

SUMMARY OF THE INVENTION

The snow glide board according to the invention is preferably a ski, in particular preferably an alpine ski. The guide or mounting elements, which are provided for example in pairs across from each other and crosswise to the longitudinal direction of the snow glide board, are preferably strip-shaped or rail-shaped guide and mounting elements, which preferably are arranged entirely or partially on opposing surfaces formed by bead-shaped protrusions on the top side of the snow glide board or in recesses there.

Further embodiments, advantages and possible applications of the invention are disclosed in the following description of exemplary embodiments and in the drawings. All characteristics described and/or pictorially represented, individually or in any combination, are subject matter of the invention.

BRIEF DESCRIPTION OF THE DRAWINGS

The invention is described below based on exemplary embodiments with reference to the drawings, in which.

DETAILED DESCRIPTION OF THE INVENTION

Figure 1:
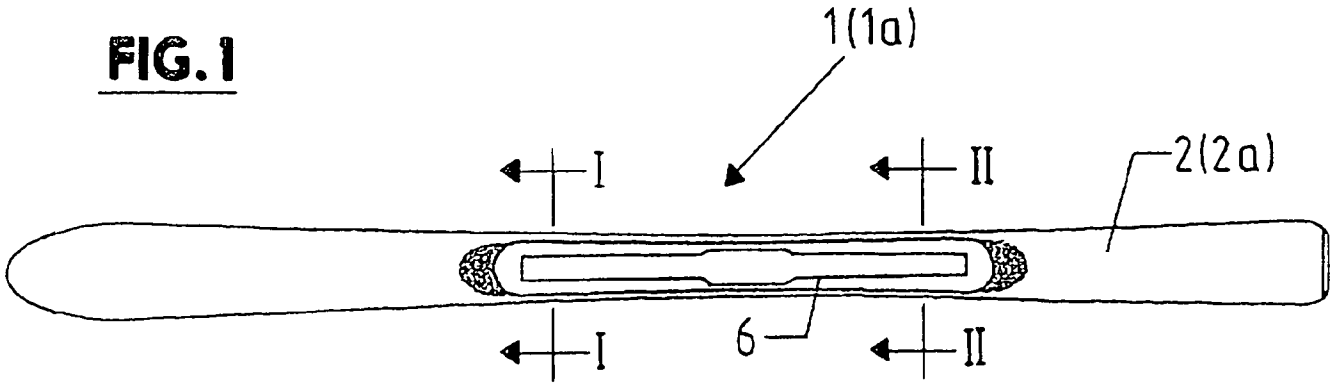
FIG. 1 shows a simplified representation in top plan view of a snow glide board in the form of a ski.
Figure 2:
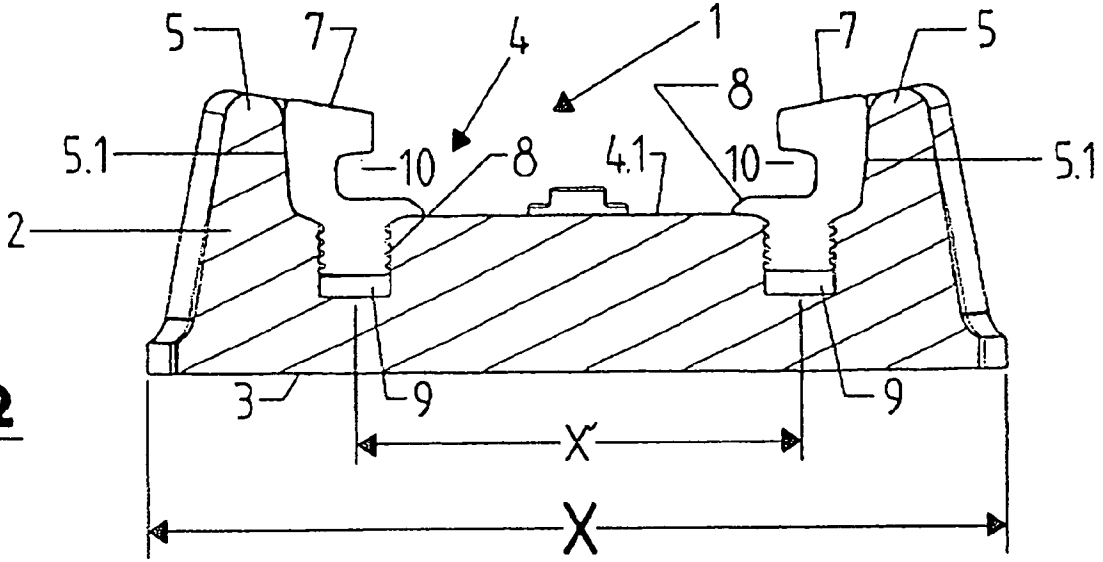
FIGS. 2 and 3 each show identical cross sections corresponding to the lines I-I and II-II for two different embodiments of the invention.

The ski generally designated 1 in FIGS. 1 and 2 consists of a ski body 2, which is manufactured using known ski construction materials in a multi-layer construction known to persons skilled in the art. In the central area or binding area the ski body 2 is designed on its top surface opposite the running surface 3 as a 3D ski with two bead-shaped protrusions 5 extending in the longitudinal direction of the ski and forming a recess 4 between them, the inner side of said protrusions being provided in recesses located there with strip-shaped mounting elements 7, which extend respectively in the longitudinal direction of the ski over a partial length of the binding area, for mounting or binding the binding 6 or binding elements depicted only very schematically in FIG. 1. The mounting elements 7, which are manufactured for example from a suitable synthetic material with sufficient strength, are anchored in the ski body 2 with formed on anchoring pegs 8 or dowels oriented with their longitudinal extension perpendicular or essentially perpendicular to the plane of the running surface 3, namely in bore holes 9, which are provided in the ski body 2 starting from the bottom 4.1 of the recess 4.

The mounting elements 7 are provided in pairs as two pairs of individual elements, namely in the longitudinal ski direction at a distance from each other so that two paired mounting elements 7 are positioned across from each other crosswise to the longitudinal extension of the ski. Further, the mounting elements 7 are formed as a C-profile so that they form guide and mounting grooves 10 that are open toward the center of the ski and the mounting elements 7 of each pair of mounting elements are positioned with the open side of the groove 10 across from each other. The grooves 10 are used for interlocking holding of sections 6.1 of the binding 6 or the binding elements.

The forces that occur between the binding 6 and the ski body 2 during skiing are transferred partially via the mounting elements supported on the bottom 4.1 of the recess 4 and on the facing inner surfaces of the protrusions 5 or on support surfaces 5.1 there, and in particular via the anchoring pegs 8 or dowels.

As shown in FIG. 1, the width of the ski body 2 is reduced in the binding area in the usual manner, i.e. the width X of the ski body in the binding area is smaller than the width X in the blade area of the ski body 2, but also smaller than the width X at the back end of the ski body.

In order to achieve sufficient transfer of force from the binding 6 to the outer edges of the ski body or to the running surface 3 despite a width X of the ski body 2 in the binding area that is significantly greater than the distance between centers x of the anchoring pegs 8 of the opposing mounting elements 7, a distance between centers x is used that is approximately 35% to 56% of the maximum width X of the ski body 2, or approximately 35% to 60% of the width X of the ski body 2 in the binding area or in the area of its greatest reduction.

In the depicted embodiment, for example, the ski body has a maximum width of 80 to 130 units and in the area of the reduction, i.e. in the binding area, a width of 77 to 127 units; the distance between centers x is then approximately 45 units. In this example, one unit is 1 mm. The distance between the two support surfaces 5.1 that are across from each other in crosswise direction is greater than the distance x, namely at least by a factor of 1.2, preferably by a factor of 1.3 to 1.4, preferably by a factor of 1.32.

The width X of the ski body 2 is the respective width at the running surface 3.

Figure 3:
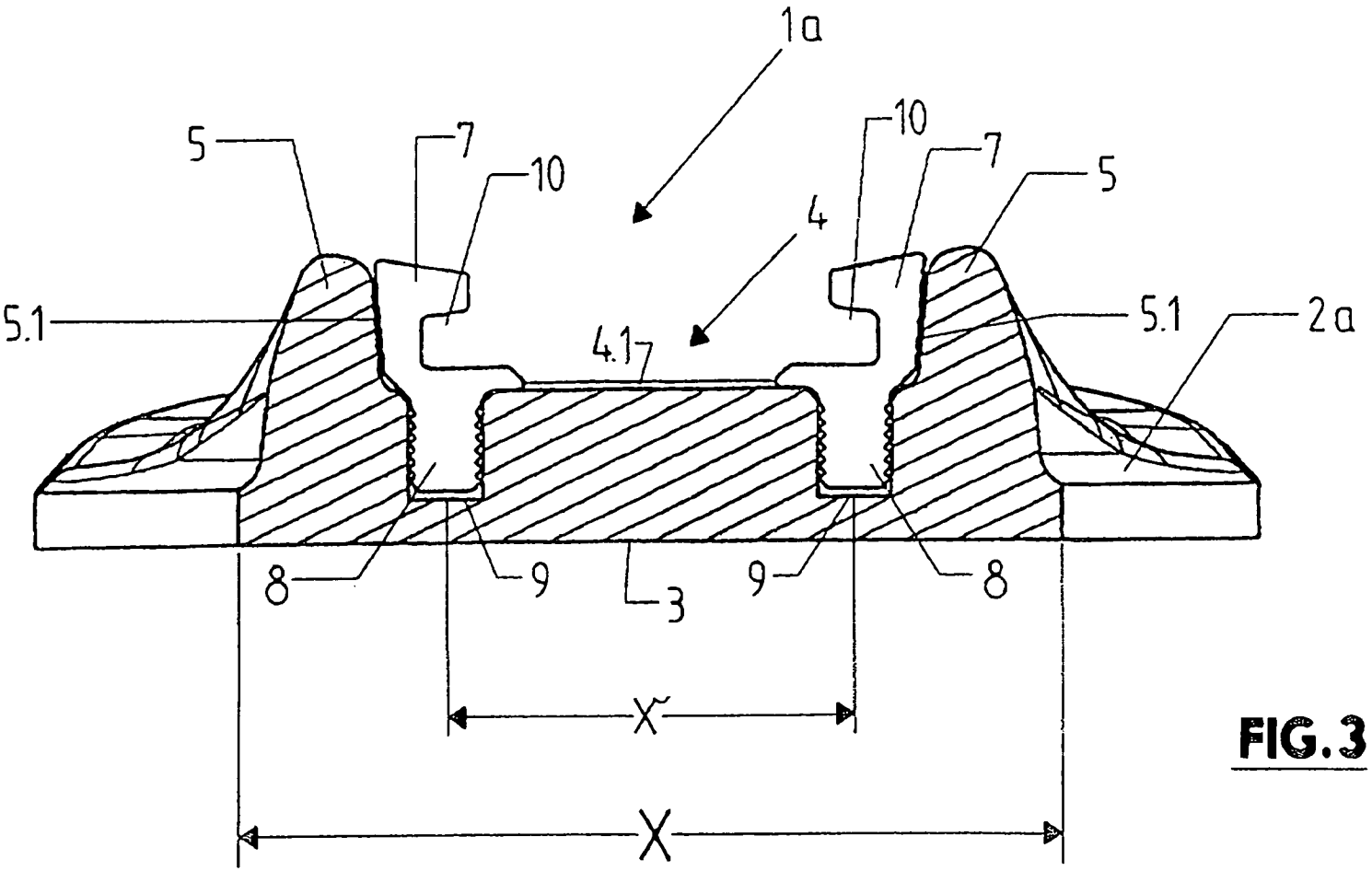

FIG. 3 shows in a representation similar to FIG. 2 as a further embodiment of the invention a ski 1*a* with a ski body 2*a*, which is reduced considerably more on its outer edges or longitudinal ski sides than the ski 1. In this embodiment the distance between centers x is approximately 45% to 52% of the width X of the ski body 2*a* in the binding area or in the area of its greatest reduction and approximately 34% of the maximum width X of the ski body 2*a*. Also in this embodiment, the distance between the two support surfaces 5.1 that are across from each other in crosswise direction is greater than the distance x, namely at least by a factor of 1.2, preferably by a factor of 1.3 to 1.4, preferably by a factor of 1.35.

The width X of the ski body 2*a* is likewise the respective width at the running surface 3.

The invention was described above based on exemplary embodiments. It goes without saying that modifications and variations are possible, without abandoning the underlying inventive idea upon which the invention is based.

REFERENCE LIST

1, 1*a* glide board or ski
2, 2*a* glide board or ski body
3 running surface
4 recess
4.1 bottom of recess 4
5 bead-shaped protrusions of ski body 2 and 2*a*
5.1 support surface
6 binding
7 strip-shaped or rail-shaped mounting elements
8 anchoring peg or dowels
9 mounting hole
10 recess in the mounting elements
x distance between mounting elements 7 and their anchoring pegs 8
X width of the glide board or ski body at the running surface 3

What is claimed is:

1. A snow glide board comprising a glide board body with bead-shaped protrusions formed on a top side of a binding area of the glide board body, the bead-shaped protrusions extending in a longitudinal direction of the glide board body and forming a glide board body recess between them on the top side of the glide board body, and further comprising two individual paired strip shaped guide and mounting elements in the binding area of the glide board body, the two individual paired strip shaped guide and mounting elements being individual elements spaced from another in a cross direction of the glide board body, wherein each of the two individual paired strip shaped guide and mounting elements have a C-shaped profile, for interlocking mounting of a binding or of elements of the binding to the top side of the glide board body, each of the two individual paired strip shaped guide and mounting elements being provided across with the C-shaped profile facing one another in the cross direction of the glide board body at a distance from each other in the binding area, the two individual paired strip shaped guide and mounting elements being each selectively mounted and removable in a mounting recess formed on inner sides of the bead-shaped protrusions facing one another on the top side of the glide board body and in the cross direction of the glide board body, the two individual paired strip shaped guide and mounting elements being supported on lateral support surfaces formed in the mounting recesses and facing one another in the cross direction of the glide board body, each of the individual two paired strip shaped guide and mounting elements being further supported on a bottom of the mounting recess on the top side of the glide board body, each of the two individual paired strip shaped guide and mounting elements being anchored by anchoring elements engaged in the glide board body, and wherein an axial distance (x) between the anchoring elements in the cross direction of the glide board body is approximately 30% to 60% of the maximum width (X) of the glide board body in the binding area.

2. The snow glide board according to claim 1, wherein the distance (x) between the anchoring elements is approximately 30% to 40% of the maximum width (X) of the glide board body.

3. The snow glide board according to claim 1, wherein the distance (x) between the anchoring elements is at least 43% and no more than 55% of the width (X) of the glide board body in the binding area.

4. The snow glide board according to claim 1, wherein with a maximum width (X) of the glide board body in the area is between 80 and 130 units, the distance (x) between the anchoring elements in the glide board body is approximately 45 units.

5. The snow glide board according to claim 1, wherein with a width (X) of the glide board body in a binding area or in an area of the at least two paired guide and mounting elements is between 65 to 79 units, the distance (x) between the anchoring elements in the glide board body is approximately 34 units.

6. The snow glide board according to claim 4, wherein a unit is one millimeter.

7. The snow glide board according to claim 5, wherein a unit is one millimeter.

8. The snow glide board according to claim 1, wherein a distance between the support surfaces is greater at least by a factor of from 1.2 to 1.4, than the distance (x) between the anchoring elements in the glide board body.

9. The snow glide board according to claim 1, wherein the anchoring elements of the individual two paired strip shaped guide and mounting elements engaging in the glide board body are anchoring pegs or dowels formed onto the individual two paired strip shaped guide and mounting elements.

10. The snow glide board according to claim 9, wherein the distance (x) between the individual two paired strip shaped guide and mounting elements is a distance between centers of the anchoring pegs or dowels.

* * * * *